US008052443B2

(12) United States Patent
Uchida et al.

(10) Patent No.: US 8,052,443 B2
(45) Date of Patent: Nov. 8, 2011

(54) CONNECTOR MOUNTING STRUCTURE

(75) Inventors: Masashi Uchida, Yokkaichi (JP); Yusuke Tsuchida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/848,268

(22) Filed: Aug. 2, 2010

(65) Prior Publication Data

US 2011/0034060 A1 Feb. 10, 2011

(30) Foreign Application Priority Data

Aug. 5, 2009 (JP) ..... 2009-182391

(51) Int. Cl.
*H01R 13/64* (2006.01)

(52) U.S. Cl. ..... 439/248; 439/544

(58) Field of Classification Search ..... 439/247, 439/248, 544
See application file for complete search history.

(56) References Cited

U.S. PATENT DOCUMENTS 6,217,363 B1 * 4/2001 Takata ..... 439/342
6,296,502 B1 * 10/2001 Takata et al. ..... 439/248
6,644,990 B1 * 11/2003 Okabe et al. ..... 439/157
7,189,101 B2 3/2007 Nagashima et al.
7,393,229 B2 * 7/2008 Yoshida et al. ..... 439/247
7,588,449 B2 * 9/2009 Takehara ..... 439/247

* cited by examiner

*Primary Examiner* — Thanh Tam Le
(74) *Attorney, Agent, or Firm* — Gerald E. Hespos; Michael J. Porco

(57) ABSTRACT

A bracket (30) includes a mounting piece (33) loosely movably supporting a connector (10) in a direction parallel with a plane intersecting a Z axis that is parallel to a longitudinal axis of the connector (10). The bracket (30) has restricting pieces (32) at opposite sides of the mounting piece (33). Locks (35) are formed at opposite sides of each restricting piece (32) and a projection (34) is formed on the outer surface of each restricting piece (32). The connector (10) includes a side wall (26A) at an inner side of each restricting piece (32), a deflecting piece (11B) for sandwiching the restricting piece (32) together with the side wall (26A). Auxiliary projections (20) are formed on the outer surface of each side wall (26A) and can contact the locks (35) from below. A restricting hole (11C) is formed in each deflecting piece (11B) for engaging the projection (34).

10 Claims, 7 Drawing Sheets

COMPARATIVE EXAMPLE

COMPARATIVE EXAMPLE

CONNECTOR MOUNTING STRUCTURE

BACKGROUND OF THE INVENTION

1. Field of the Invention

The invention relates to a connector mounting structure.

2. Description of the Related Art

U.S. Pat. No. 7,189,101 discloses an electrical component with a connector that is loosely movably supported in a bracket. The electrical component may be used, for example, in an automatic transmission of an automotive vehicle. The connector is mounted in a mount hole of a mating member by assembling the electrical component with the mating member. The loose movable support of the connector on the bracket prevents exertion of unnecessary force on the connector as the connector is being mounted into the mount hole. However, the connector easily inclines with respect to a proper mounting direction before mounting the connector and the axial center of the connector is not easily oriented toward the mount hole. Loose movements of the connector with respect to the bracket can be restricted, but a mount position cannot be adjusted finely when attaching another part to the bracket after the connector has been mounted.

The above-described problems could be addressed by a bracket that can be moved loosely with respect to the connector after the connector is mounted into the mount hole to enable a fine adjustment of the mount position. However, measures also should be taken to prevent the loosely movable connector from being detached from the bracket.

The invention was developed in view of the above situation and an object thereof is to permit a movement of a connector in a direction intersecting a proper mounting direction and to prevent detachment of the connector from a bracket while restricting the inclination of the connector with respect to the proper mounting direction.

SUMMARY OF THE INVENTION

The invention relates to a connector mounting structure for mounting a connector at a specified mounting position of a mating member. The connector mounting structure includes the connector and a support that loosely movably supports the connector. The connector has an axial center line that is parallel to a Z axis when the connector has been mounted at the specified mounting position. The support includes a mounting piece for loosely movably supporting the connector in a direction substantially parallel with a plane intersecting with the Z axis. The support also has two restricting pieces at substantially opposite sides of the mounting piece, two locks at substantially opposite sides of each restricting piece and a projection on the outer surface of each restricting piece. The connector include: a connecting portion that is loosely movably mountable on the mounting piece of the support. An inner wall is provided at an inner side of each restricting piece and a deflecting piece is provided at an outer side of each restricting piece so that the restriction piece is sandwiched between the inner wall and the deflecting piece. Two auxiliary projections are formed on the outer surface of each inner wall at positions corresponding to the locks and contact the locks axially from below. A restricting hole formed in each deflecting piece for engaging the projection.

The engagement of the projections with the restricting holes prevents the connector from inclining with respect to a proper mounting direction. Further, the contact of the auxiliary projections on the outer surface of each inner wall of the connector with the corresponding locks of the support from below prevents detachment of the connector from the support.

The mounting piece preferably has a first wide portion and a second wide portion adjacent to the first wide portion. The second wide portion preferably is slightly wider than the first wide portion and a vertically longer than the first wide portion.

The connecting portion preferably has a first insertion groove for receiving the first wide portion of the mounting piece and a second insertion groove for receiving the second wide portion of the mounting piece. The first insertion groove is substantially above the second insertion groove.

A first accommodation space preferably is formed in the connecting portion above the first insertion groove and can receive the first wide portion. A dimension of the first accommodation space in forward and backward directions exceeds the corresponding dimension of the first wide portion, and the width of the first accommodation space exceeds the width of the first wide portion. Thus, the first wide portion can move freely in the first accommodation space in forward and backward directions and width directions.

A second accommodation space preferably is formed in the connection portion between the first and second insertion grooves and can receive the second wide portion. A dimension of the second accommodation space in forward and backward directions exceeds the corresponding dimension of the second wide portion and the width of the second accommodation space exceeds the width of the second wide portion. Thus, the second wide portion can move freely in the second accommodation space in forward and backward directions and in width directions.

The connecting portion preferably has protection walls adjacent to the insertion grooves so that the insertion grooves will not be damaged by an external impact.

The connecting portion of the connector preferably is mounted on the mounting piece of the support so that: the first wide portion is in the first accommodation space, a first narrow portion is arranged between the first insertion grooves, the second wide portion is in the second accommodation space and a second narrow portion is arranged between the second insertion grooves. Thus, the connector is supported by the mounting piece for loose movement in the width direction and forward and backward directions with respect to the mounting piece.

A distance between the inner wall and the deflecting piece preferably exceeds a thickness of the restricting pieces. Thus, the connector is loosely movable in the width direction with respect to the support by as much as a difference between the distance and the thickness.

The projection preferably is located in a corresponding restricting hole that is long in forward and backward directions. Additionally, the inner side surface of the deflecting piece is separated from the outer surface of the restricting piece. Thus, the connector can move freely in the width direction and in forward and backward directions.

The engagement of the projections with the restricting holes or the engagement of the locks and the auxiliary projections preferably prevents inclination of the connector with respect to the support.

The above-described construction permits movement of a connector in a direction intersecting a proper mounting direction and prevents detachment of the connector from a bracket while restricting the inclination of the connector with respect to the proper mounting direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
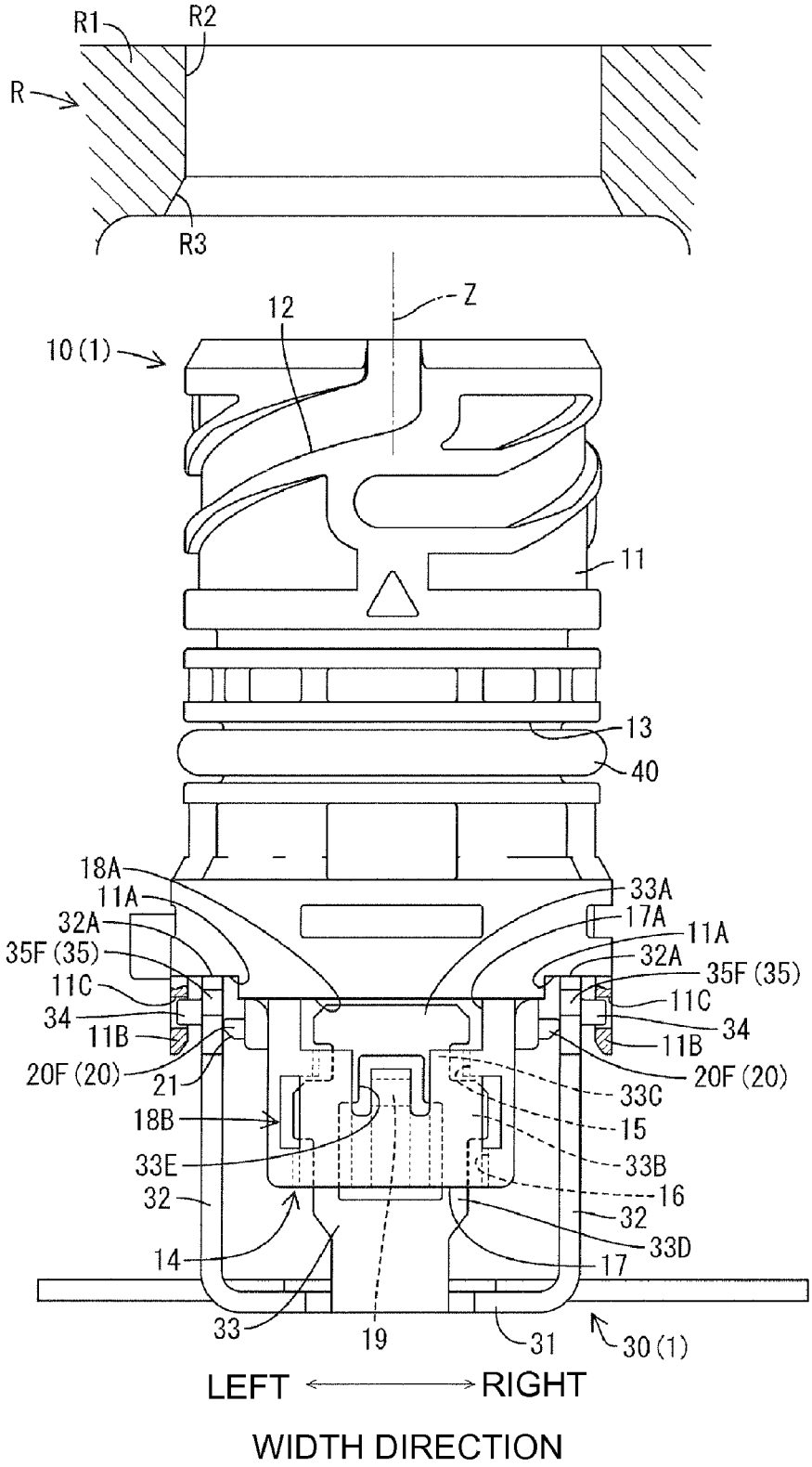
FIG. 1 is a front view, partly in section, of a connector and a bracket in accordance with the invention.
Figure 2:
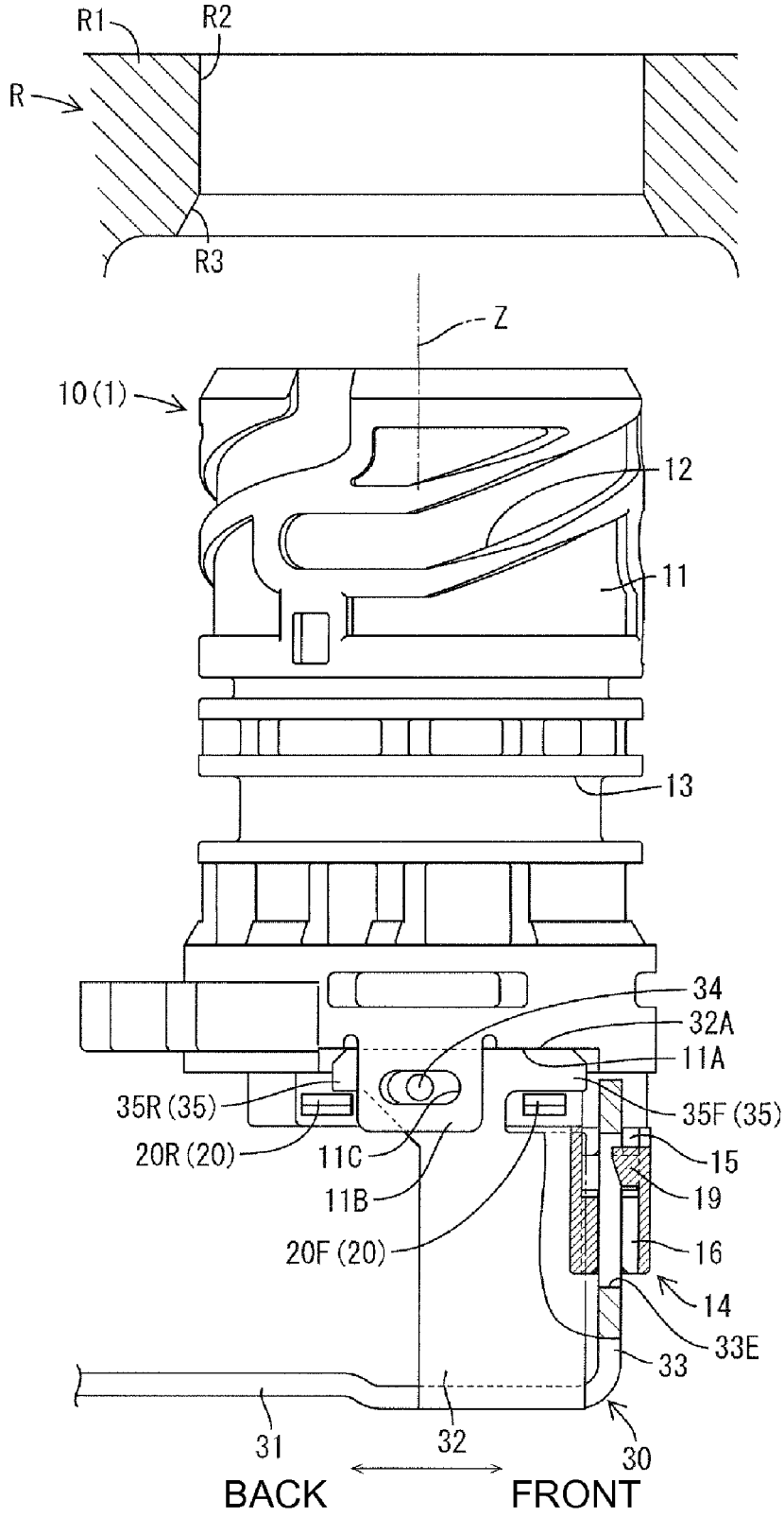
FIG. 2 is a side view partly in section showing the connector and the bracket.

An electrical component in accordance with the invention is identified by the numeral 1 in FIGS. 1 to 8. The electrical component 1 is arranged on an automatic transmission case of an automotive vehicle (not shown) and can be connected electrically to an external circuit via a case R. In the following description, the width direction corresponds to lateral directions of FIG. 1 and forward and backward directions correspond to lateral directions of FIG. 2. The right side of FIG. 2 is referred to as the front and the vertical direction of FIGS. 1 and 2 is referred to as the vertical direction.

The case R includes a plate R1 made e.g. of synthetic resin. The plate R1 has an external-circuit connecting portion (not shown) to be connected with the external circuit and an electrical-component connecting portion (not shown) to be connected with the electrical component 1. The electrical-component connecting portion is provided in a mount hole R2 in the lower surface of the plate R1, as shown in FIG. 1. Further, at least one guiding surface R3 is formed circumferentially at the opening edge of the mount hole R2 and is inclined to gradually increase the opening toward the outer side (the lower side in FIG. 1).

The electrical component 1 includes a connector 10 and a bracket 30 that is mounted on the bottom end of the connector 10 so that the connector 10 is supported on the bracket 30 in a manner that permits loose movement. The electrical component 1 is assembled into the case R so that the connector 10 is mounted in the mount hole R2 of the case R. The axial center or longitudinal axis of the connector 10 that has been inserted in the mount hole R2 is substantially parallel to a Z-axis shown in FIGS. 1 and 2.

The bracket 30 is formed by punching or cutting a conductive metal plate and bending the punched-out plate. The bracket 30 includes a flat base 31 extending in forward and backward directions. A mounting piece 33 project up from the front edge of the base 31 and two restricting pieces 32 project up from the opposite widthwise sides of the base 31 to face each other at the opposite sides of the mounting piece 33.

The mounting piece 33 includes a first wide portion 33A and a second wide portion 33B formed below the first wide portion 33A. The second wide portion 33B is set to be slightly wider than the first wide portion 33A and is vertically longer than the first wide portion 33A. A first narrow portion 33C is formed between the first and second wide portions 33A and 33B and is narrower than the first and second wide portions 33A and 33B. A second narrow portion 33D is continuous with the bottom end of the second wide portion 33B and is narrower than the second wide portion 33B. A retaining hole or recess 33E penetrates the mounting piece 33 in a thickness direction in a range of the mounting piece 33 from the first narrow portion 33C to the second narrow portion 33D and an upper end of the retaining hole 33E is formed to be narrow.

As shown in FIG. 2, each restricting piece 32 has a vertically long rectangular base end and front and rear locks 35F and 35R that extend forward and backward respectively from top areas of the restricting piece 32. Substantially cylindrical projections 34 project laterally from the outer left and right surfaces of the respective restricting pieces 32, as shown in FIG. 1.

Figure 3:
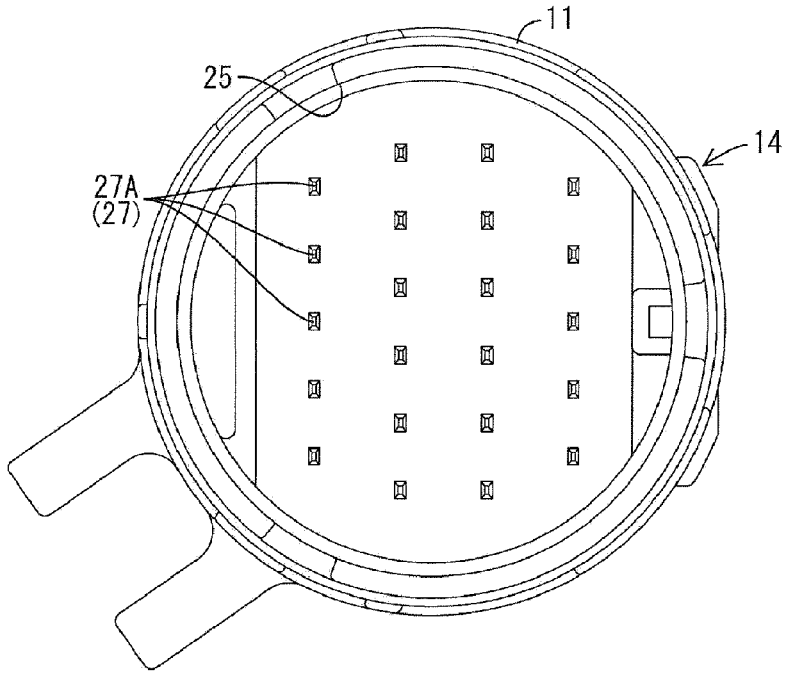
FIG. 3 is a plan view showing the connector.
Figure 4:
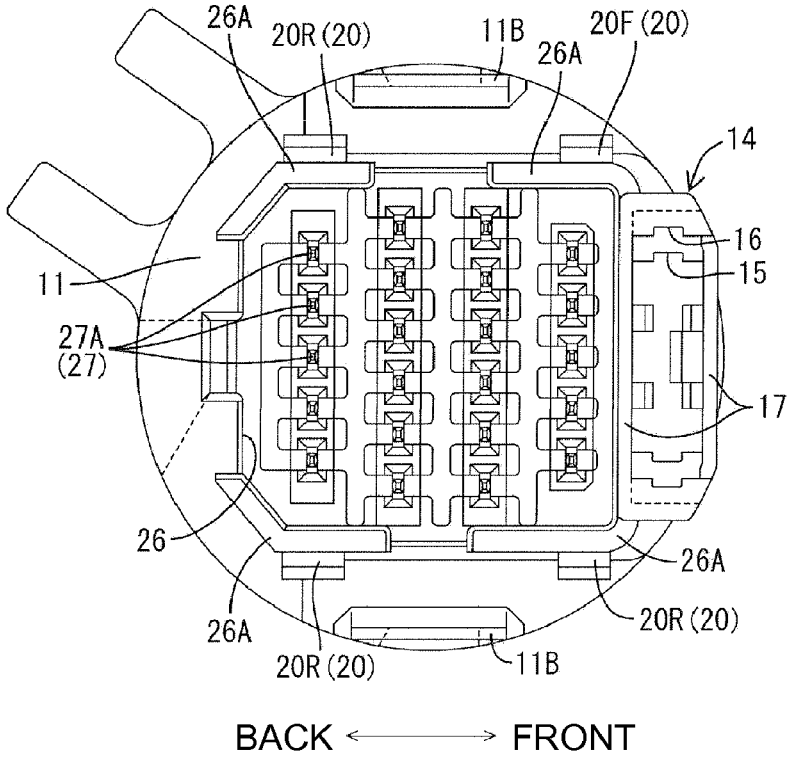
FIG. 4 is a bottom view showing the connector.

The connector 10 has a substantially cylindrical tubular main portion 11 with upper and lower end openings 25, 26. Terminal fittings 27 are installed in the main portion 11. Male tabs 27A are formed at the opposite ends of each terminal fitting 27 and project into the upper and lower openings 25, 26 (FIGS. 3 and 4).

At least one spiral cam groove 12 is formed in an upper end portion of the outer circumferential surface of the main portion 11. On the other hand, the electrical-component connecting portion includes a rotational member (not shown). At least one cam pin (not shown) is provided on the rotational member (not shown) and can enter the cam groove 12 when the connector 10 is inserted into the mount hole R2. The rotational member then can be rotated so that the cam pins cooperate with the cam grooves 12 to urge the connector 10 toward the upper end of the mount hole R2. The connector 10 is connected properly with the electrical-component connecting portion when the connector 10 reaches a proper insertion position in the mount hole R2.

A rubber-plug mount groove 13 is formed circumferentially in the outer circumferential surface of the main portion 11 below the cam groove 12. A resilient or rubber ring 40 is to be mounted in the rubber-plug mount groove 13. The rubber ring 40 closely contacts the inner circumferential surface of the mount hole R2 and the circumferential surface of the mount groove 13 over substantially the entire circumference when the main portion 11 is inserted into the mount hole R2. Thus, water or fluid cannot enter into the interior of the mount hole R2 from the outside.

A bracket connecting portion 14 projects down from the front edge of a bottom end part of the main portion 11 and is loosely movable with respect to the mounting piece 33 of the bracket 30. Flat contact surfaces 11A are formed at the opposite widthwise sides of the bottom of the main portion 11. The contact surfaces 11A contact upper horizontal surfaces 32A of the restricting pieces 32 with the connector 10 loosely movably mounted on the bracket 30.

As shown in FIGS. 1 and 4, the bracket connecting portion 14 has a first insertion groove 15 and a second insertion groove 16 below the first insertion groove 15. The first wide portion 33A of the mounting piece 33 can be inserted in the first insertion groove 15 and the second wide portion 33B of the mounting piece 33 can be inserted in the second insertion groove 16. The bracket connecting portion 14 also has two protection walls 17 respectively arranged adjacent to the upper and lower sides of the insertion grooves 15, 16 to protect the insertion grooves 15, 16 from damage by an external impact.

A first accommodation space 18A is formed in the bracket connecting portion 14 above the first insertion groove 15 and can accommodate the first wide portion 33A. A dimension of the first accommodation space 18A in forward and backward directions exceeds the corresponding dimension of the first wide portion 33A, and the width of the first accommodation space 18A exceeds the width of the first wide portion 33A. Thus, the first wide portion 33A is freely movable in the first accommodation space 18A in forward and backward directions and in width directions between the two protection walls 17.

The first accommodation space 18A faces forward through a substantially T-shaped cutout 17A in the protection wall 17. A locking piece 19 is formed at the bottom end of the cutout 17A and projects toward the mounting piece 33. The locking piece 19 is resiliently deformable forward and back in the thickness direction of the protection wall 17.

A second accommodation space 18B is formed in the bracket connecting portion 14 between the first and second insertion grooves 15, 16 and can accommodate the second wide portion 33B. A dimension of the second accommodation space 18B in forward and backward directions exceeds the corresponding dimension of the second wide portion 33B, and the width of the second accommodation space 18B exceeds the width of the second wide portion 33B. Thus, the second wide portion 33B is freely movable in the second accommodation space 18B in forward and backward directions and in width directions between the two protection walls 17.

The first narrow portion 33C is formed in the mounting piece 33 between the first and second wide portions 33A, 33B and is narrower than the wide portions 33A, 33B. The first narrow portion 33C is inwardly of the first insertion grooves 15 with respect to the width direction and is freely movable in forward and backward directions and in the width directions between the two protection walls 17. The second narrow portion 33D is formed in the mounting piece 33 below the second wide portion 33B and is narrower than the second wide portion 33B. The second narrow portion 33D is inwardly of both second insertion grooves 16 with respect to the width direction and is freely movable in forward and backward directions and in width directions between the two protection walls 17.

The bracket connecting portion 14 of the connector 10 is mounted on the mounting piece 33 of the bracket 30 so that: the first wide portion 33A is in the first accommodation space 18A, the first narrow portion 33C is between the first insertion grooves 15, the second wide portion 33B is in the second accommodation space 18B and the second narrow portion 33D is between the second insertion grooves 16, as shown in FIG. 1. Thus, the connector 10 is supported by the mounting piece 33 for loose movement in the width direction and forward and backward directions with respect to the bracket 30.

The contact of the connector 10 with the restricting pieces 32 prevents the axial center of the connector 10 from inclining with respect to the Z axis by. More particularly, two deflecting pieces 11B project axially down from outer edges of the contact surfaces 11A of the main portion 11 of the connector 10. The deflecting pieces 11B face each other in the width direction and are arranged at outer sides of the corresponding restricting pieces 32. The deflecting pieces 11B can be deflected out in the width direction. A restricting hole 11C penetrates each deflecting piece 11B in the width direction. The leading ends of the respective projections 34 can fit in the corresponding restricting holes 11C at a substantially center position of FIG. 1 so that the axial center of the connector 10 is between the restricting pieces 32. The restricting holes 11C are long and the dimensions of the restricting holes 11C in forward and backward directions exceed the diameters of the projections 34. Thus, the connector 10 can move loosely in forward and backward directions. A vertical dimension of the restricting holes 11C slightly exceeds the diameters of the projections 34.

A force could be applied to incline the connector 10 to the left in the width direction of FIG. 1 while with the leading ends of the projections 34 in the restricting holes 11C. However, the lower part of the inner peripheral surface of the right restricting hole 11C in FIG. 1 contacts the lower part of the outer circumferential surface of the right projection 34, the upper part of the inner peripheral surface of the left restricting hole 11C contacts the upper part of the outer circumferential surface of the left projection 34 and/or the left contact surface 11A contacts the upper horizontal surface 32A of the left restricting piece 32. Thus, the restricting pieces 32 contact the opposite widthwise sides of the connector 10 to prevent inclination of the connector 10 to the left.

Similarly, a force could be applied to incline the connector 10 to the right in FIG. 1. However, the lower part of the inner peripheral surface of the left restricting hole 11C contacts the lower part of the outer circumferential surface of the left projection 34, the upper part of the inner peripheral surface of the right restricting hole 11C contacts the upper part of the outer circumferential surface of the right projection 34 and/or the right contact surface 11A contacts the upper horizontal surface 32A of the right restricting piece 32. Thus, the connector 10 is held in contact with the restricting pieces 32 contact the opposite widthwise sides of the connector 10 to prevent inclination of the connector 10 to the right against a rotational moment.

A force could be applied to incline the connector 10 back with the leading ends of the projections 34 inserted in the restricting holes 11C, as shown in FIG. 2. However, the lower parts of the inner peripheral surfaces of the restricting holes 11C contact the lower parts of the outer circumferential surfaces of the projections 34 and the contact surfaces 11A contact with the rear ends of the upper horizontal surfaces 32A of the restricting pieces 32. In this way, the inclination of the connector 10 to the back against a rotational moment of the connector 10 is prevented.

A force could be applied to incline the connector 10 to the front with the leading ends of the projections 34 in the restricting holes 11C. However, the contact surfaces 11A contact the front ends of the upper horizontal surfaces 32A of the restricting pieces 32 and the lower parts of the inner peripheral surfaces of the restricting holes 11C contact the lower parts of the outer circumferential surfaces of the projections 34. In this way, the inclination of the connector 10 to the front against a rotational moment is prevented. The above description is based on the state where the connector 10 is located substantially in the center in a movable range in forward and backward directions (state of FIG. 2). However, forward, rearward, left or right inclination of the connector 10 is prevented substantially in the manner described above even if the connector 10 moves parallel with its front or rear end position.

Figure 5:
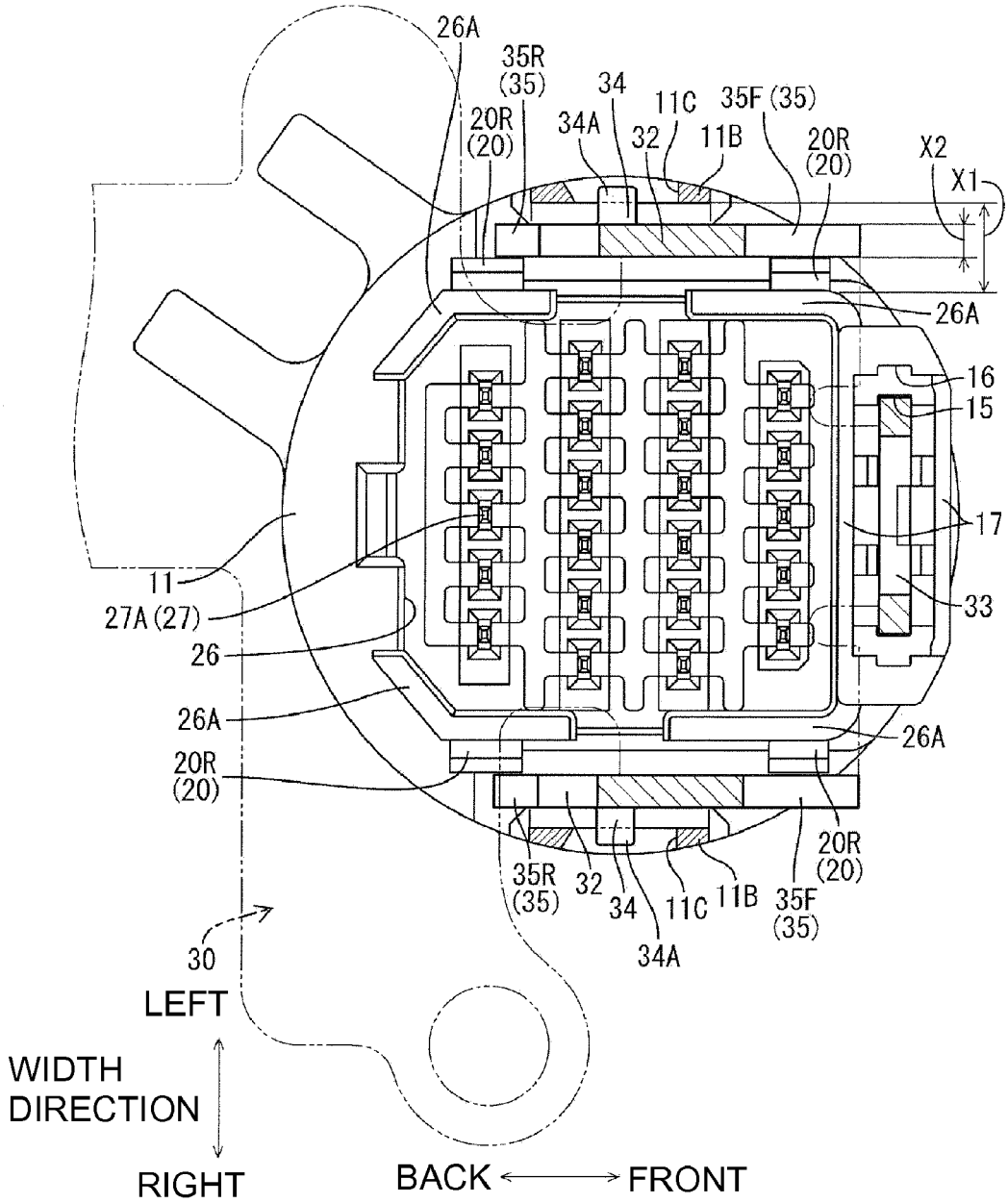
FIG. 5 is a bottom view partly in section showing the connector and the bracket.

The inclination of the connector 10 to the front, back, left and right is prevented with the leading ends of the projections 34 inserted in the restricting holes 11C as described above. However, the connector 10 may be moved to the right from the state shown in FIG. 1. In this case, the projection 34 of the left restricting piece 32 remains in the restricting hole 11C of the left deflecting piece 11B, but the projection 34 of the right restricting piece 32 comes out of the restricting hole 11C of the right deflecting piece 11B. A force could be applied to incline the connector 10 to the left in such a state and could cause the connector 10 to be detached from the bracket 30. Accordingly, auxiliary projections 20 are provided to prevent such detachment. As shown in FIG. 5, a peripheral wall projects axially down to at least partly surround the lower opening 26 in the main portion 11 of the connector 10 and is defined partly by side walls 26A that are located at the inner sides of the respective restricting pieces 32 and in positions to substantially face the corresponding deflecting pieces 11B. The side walls 26A and the deflecting pieces 11B are arranged to sandwich the corresponding restricting pieces 32 from the outer and inner sides. A distance X1 between the side walls 26A and the deflecting pieces 11B exceeds a thickness X2 of the restricting pieces 32. Therefore, the connector 10 is loosely movable in the width direction with respect to the bracket 30 by as much as a difference between the distance X1 and the thickness X2.

Auxiliary projections 20 are formed at the substantially opposite front and rear ends of each side wall 26A and project toward the restricting piece 32. As shown in FIG. 2, the auxiliary projections 20 align with the respective locks 35 of the corresponding restricting piece 32, and upper surfaces of the auxiliary projections 20 can contact the lower surfaces of the corresponding locks 35 from below. Further, as shown in FIG. 1, an inclined surface 21 is formed on the bottom of each auxiliary projection 20 and inclines up toward the outer side.

The auxiliary projections 20 are arranged so as not to touch the lower surfaces of the corresponding locks 35 when the bracket 30 and the connector 10 are at the center position shown in FIG. 1. The left projections 34 disengage from the left restricting holes 11C if the connector 10 moves left from the state of FIG. 1, but the left locks 35 and the left auxiliary projections 20 contact instead. More specifically, the front locks 35F and the front auxiliary projections 20F and the rear locks 35R and the rear auxiliary projections 20R can contact (see also FIG. 2) to prevent inclination of the connector 10 to the front, back and/or right. If the connector 10 tries to incline to the left in this state, the lower side of the inner peripheral surface of the right restricting hole 11C contacts the lower side of the outer circumferential surface of the right projection 34 to prevent inclination of the connector 10 to the right. If the connector 10 moves in parallel to the right from the state of FIG. 1, the right projection 34 and the right restricting hole 11C disengage and, instead, the right locks 35 and the right auxiliary projections 20 contact to prevent inclination of the connector 10.

The connector 10 is mounted on the bracket 30 so that the mounting piece 33 of the bracket 30 enters the bracket connecting portion 14 of the connector 10. As a result, the locking piece 19 is fit resiliently into the retaining hole 33E and at the same time, the deflecting pieces 11B move over the corresponding projections 34 while deforming out away from each other in the width direction. The deflecting pieces 11B then resiliently restore so that the projections 34 fit into the corresponding restricting holes 11C. In this state, the first wide portion 33A is in the first accommodation space 18A, the first narrow portion 33C is between the first insertion grooves 15, the second wide portion 33B is in the second accommodation space 18B and the second narrow portion 33D is between the second insertion grooves 16. Further, the projections 34 are located in the corresponding restricting holes 11C. The inner side surfaces of the deflecting pieces 11B and the outer side surfaces of the restricting pieces 32 are separated by a specified distance. Therefore the connector 10 can move freely in the width direction and/or forward and backward directions.

The electrical component 1 is assembled into the case R by bringing the connector 10 closer to the opening edge of the mount hole R2 while inclining the electrical component 1 various directions depending on assembling environment. At this time, an operator needs to assemble the electrical component 1 into the case R by holding the bracket 30 and the connector 10 may be hidden behind the bracket 30 and not seen. In such a case, the connector 10 may be inclined with respect to the bracket 30 and pushed into the mount hole R2 while being inclined. Thus, the leading end portion of the connector 10 interferes with the opening edge of the mount hole R2, making it difficult to insert the leading end portion of the connector 10 into the mount hole R2.

However, the engagement of the projections 34 with the restricting holes 11C or the engagement of the locks 35 with the auxiliary projections 20 prevent inclination of the connector 10 with respect to the bracket 30. Thus, the axial center of the connector 10 can be held substantially aligned with the proper mounting direction (Z axis direction), so that the connector 10 can be centered easily with respect to the mount hole R2.

The connector 10 can be inserted into the mount hole R2 by assembling the electrical component 1 into the case R while centering the connector 10 as described above. At this time, the direction of a force for pushing the electrical component 1 toward the case R may deviate from the Z axis direction. However, the connector 10 can move loosely to the front, rear, left and/or right with respect to the bracket 30, and the direction of the force can be corrected to the Z axis direction. In addition, an assembling error of the connector 10 with respect to the bracket 30 can be absorbed and the connector 10 can be inserted smoothly into the mount hole R2.

Another part may be mounted on the bracket 30 after the connector 10 is mounted into the mount hole R2. Even in such a case, the bracket 30 is freely movable to the front, rear, left and right with respect to the connector 10, so that the mount position can be finely adjusted and the other part can be mounted easily mounted.

Locks 35F and 35R are formed at the opposite front and rear sides of each restricting piece 32 and auxiliary projections 20F and 20R also are formed at the front and rear sides. Therefore the locks 35 and the auxiliary projections 20 can be engaged reliably, as described in detail with reference to FIGS. 5 to 8. The connector 10 is loosely movable in forward and backward directions and in width directions with respect to the bracket 30. As a result the connector 10 can rotate slightly about its center axis (axis extending in a direction penetrating the plane of FIG. 5) (see FIGS. 5 and 6).

Figure 6:
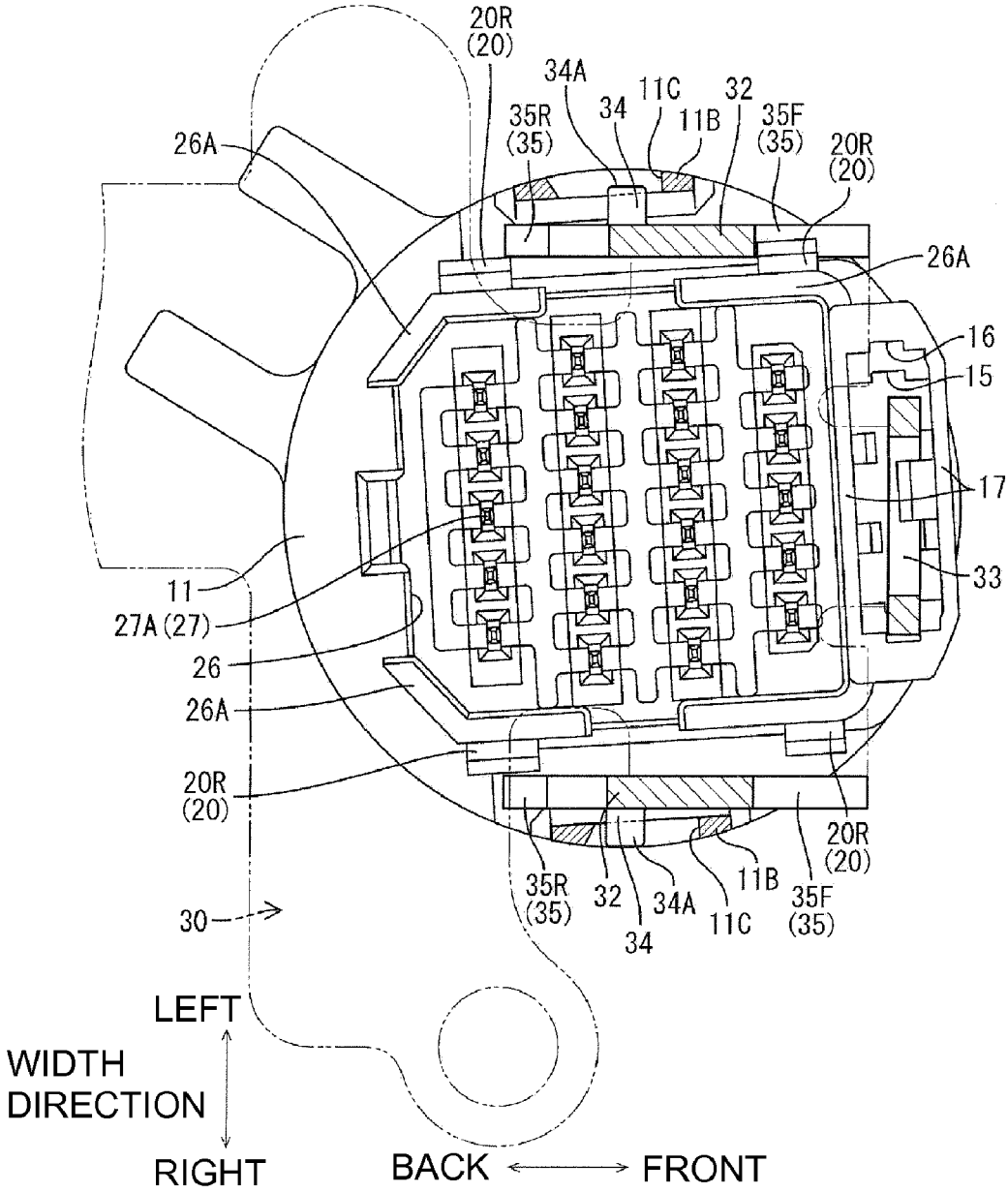
FIG. 6 is a bottom view partly in section showing a state where the connector rotates about its axial center with respect to the bracket.

The connector 10 may rotate about the center axis in a counterclockwise direction of FIG. 5 while the connector 10 and the bracket 30 have the positional relationship shown in FIG. 6. In this case, the rear auxiliary projection 20R and the rear lock 35R are not engaged, but the front auxiliary projection 20F and the front lock 35F are engaged at the left restricting piece 32. If either one of the auxiliary projections 20 is engaged with the lock 35 in this way, the detachment of the connector 10 from the bracket 30 is prevented even if the connector 10 receives a force in a direction away from the bracket 30. If the connector 10 rotates about its center axis in a clockwise direction of FIG. 5, the rear auxiliary projection 20R and the rear lock 35R engage to prevent the connector 10 from being detached from the bracket 30.

Figure 7:
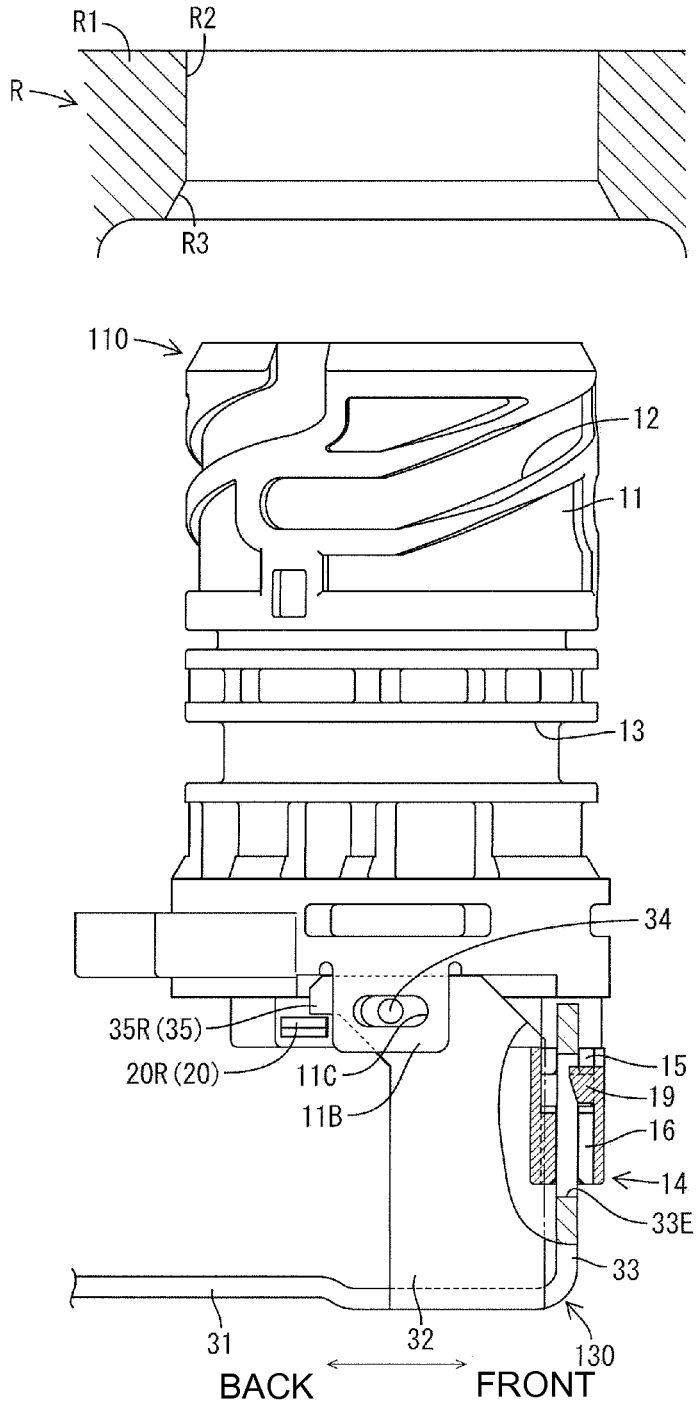
FIG. 7 is a side view partly in section showing a comparative example.
Figure 8:
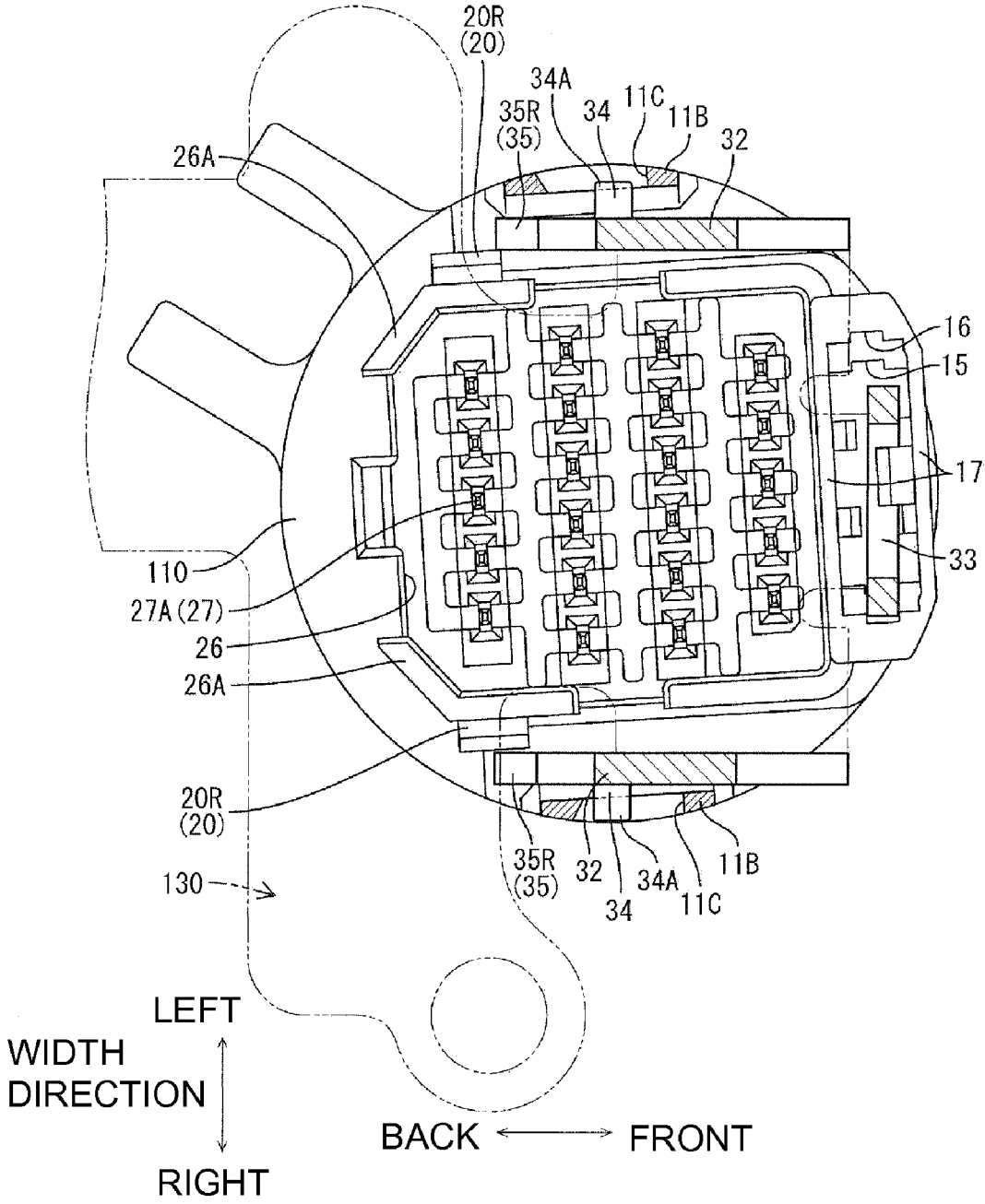
FIG. 8 is a bottom view partly in section showing a state where a connector rotates about its axial center with respect to a bracket in the comparative example.

A connector 110 with no front auxiliary projections 20F and a bracket 130 with no front locks 35F are illustrated in FIGS. 7 and 8 as a comparative example for easier understanding of the above effect. The constructions of the connector 110 and the bracket 130 are identical to those of the connector 10 and the bracket 30 except that no front auxiliary projections 20F and no front locking portions 35F are provided. The same parts are identified by the same reference numerals. As shown in FIG. 8, a left restricting piece 32 is engaged with the connector 110 only by the engagement of a left projection 34 and a left restricting hole 11C if a positional relationship of the connector 110 and the bracket 130 is the same as the one of the connector 10 and the bracket 30 (shown in FIG. 6). In a state shown in FIG. 8, the left projection 34 and the left restricting hole 11C are engaged relatively lightly as compared with the state shown in FIG. 5. Further, deflecting pieces 11B are resiliently deformable outwardly. Thus, if the connector 110 receives a force in a direction away from the bracket 130, the left projection 34 and the left restricting hole 11C may disengage and the connector 110 may detach from the bracket 130. In FIGS. 5, 6 and 8, parts of the projections 34 engaged with the restricting holes 11C are identified by 34A (parts located more outward than broke lines in FIGS. 5, 6 and 8).

In this respect, the preferred embodiment has the pairs of front and rear auxiliary projections 20 and the locks 35 that are engageable with the auxiliary projections 20. Thus, at least one of each pair of auxiliary projections 20 can be engaged with the corresponding lock 35 even if the connector 10 rotates about its axial center and the connector 10 and the bracket 30 have a specific positional relationship as shown in FIG. 6. Thus, the detachment of the connector 10 from the bracket 30 can be prevented.

As described above, in the connector mounting structure according to this embodiment, the restricting pieces 32 are formed with the projections 34, the deflecting pieces 11B are formed with the restricting holes 11C and the projections 34 and the restricting holes 11C are engaged. Thus, the engaging action of the projections 34 and the restricting holes 11C prevent the connector 10 from inclining with respect to the proper mounting direction. Further, the pairs of auxiliary projections 20 are formed on the outer surfaces of the side walls 26A of the connector 10 and contact the corresponding pairs of the locks 35 of the bracket 30 from below. Therefore, the detachment of the connector 10 from the bracket 30 can be prevented.

The invention is not limited to the above described and illustrated embodiment. For example, the following embodiments are also included in the technical scope of the present invention.

The mounting structure for the connector 10 and the mounting piece 33 is not limited to the one of the above embodiment. It is sufficient for the mounting piece 33 to loosely movably support the connector 10 in a direction parallel with a plane intersecting with the Z axis.

Although the projections 34 are cylindrical in the above embodiment, the shape thereof is not limited to this. The projections 34 may be so shaped as to be engageable with the inner circumferential surfaces of the restricting holes 11C.

Although the auxiliary projections 20 are so arranged as not to be in contact with the lower surfaces of the corresponding locking portions 35 when the bracket 30 and the connector 10 are at the center position shown in FIG. 1, they may be so arranged as to be in contact with the lower surfaces of the locking portions 35 at the center position.

What is claimed is:

1. A connector mounting structure for mounting at a specified mounting position of a mating member, comprising:

a support including a base, first and second opposed restricting pieces extending from the base, the restricting pieces having inner surfaces facing one another and outer surfaces facing away from one another, first and second projections projecting respectively from the outer surfaces of the first and second restricting pieces at locations spaced from the base, front and rear locks formed at opposite front and rear ends of each of the restricting pieces at locations spaced from the base, a mounting piece extending substantially transverse to the first and second restricting pieces at locations in proximity to the front ends of each of the restricting pieces; and a connector including a connecting portion loosely movably mounted on the mounting piece of the support, first and second inner walls facing the inner surfaces of the respective first and second restricting pieces, first and second deflecting pieces facing the outer surfaces of the respective first and second restricting pieces, front and rear auxiliary projections formed on each of the inner walls and aligned respectively with the front and rear locks at positions between the respective locks and the base and disposed to contact the locks in response to an inclination of the connector, a restricting hole formed in each deflecting piece for engaging the respective projection.

2. The connector mounting structure of claim 1, wherein the mounting piece has a first wide portion and a second wide portion between the first wide portion and the base, the second wide portion being wider and longer than the first wide portion.

3. The connector mounting structure of claim 2, wherein the connecting portion includes first and second insertion grooves, the first and second wide portions of the mounting piece being disposed respectively in the first and second insertion grooves.

4. The connector mounting structure of claim 3, wherein the connecting portion has a first accommodation space above the first insertion groove for accommodating the first wide portion, a dimension of the first accommodation space in forward and backward directions exceeding a corresponding dimension of the first wide portion, and a width of the first accommodation space exceeding a width of the first wide portion so that the first wide portion is freely movable in forward and backward directions and width directions in the first accommodation space.

5. The connector mounting structure of claim 4, wherein the connecting portion has a second accommodation space between the first and second insertion grooves for accommodating the second wide portion, a dimension of the second accommodation space in forward and backward directions exceeding a corresponding dimension of the second wide portion, and a width of the second accommodation space exceeding a width of the second wide portion so that the second wide portion is freely movable in forward and backward directions and width directions in the second accommodation space.

6. The connector mounting structure of claim 5, wherein the connecting portion includes at least one protection wall substantially adjacent the insertion grooves for preventing the insertion grooves from being damaged by an external impact.

7. The connector mounting structure of claim 3, wherein the mounting piece of the support has a first narrow portion between the first insertion grooves and a second narrow portion between the second insertion grooves, the first and second narrow portions being dimensioned relative to the first and second insertion grooves so that the connector is loosely movable in the width direction and forward and backward directions with respect to the mounting piece.

8. The connector mounting structure of claim 1, wherein a distance between the inner wall and the deflecting piece exceeds a thickness of the restricting pieces so that the connector is loosely movable in the width direction with respect to the support by as much as a difference between the distance and the thickness.

9. The connector mounting structure of claim 1, wherein the restricting holes are long in forward and backward directions and wherein the inner surface of the first and second deflecting pieces and the outer side surface of the first and second restricting pieces are separated by specified distances so that the connector is permitted to move freely in the width directions and forward and backward directions.

10. The connector mounting structure of claim 1, wherein inclination of the connector with respect to the support is prevented by the engagement of the projections and the restricting holes or engagement of the locks and the auxiliary projections.

* * * * *